United States Patent [19]

Beatenbough

[11] Patent Number: 4,932,469

[45] Date of Patent: Jun. 12, 1990

[54] AUTOMOTIVE CONDENSER

[75] Inventor: Paul K. Beatenbough, Medina, N.Y.

[73] Assignee: Blackstone Corporation, Jamestown, N.Y.

[21] Appl. No.: 417,049

[22] Filed: Oct. 4, 1989

[51] Int. Cl.[5] ..... F28F 3/04

[52] U.S. Cl. ..... 165/153; 29/890.035; 29/890.07; 165/170; 165/175

[58] Field of Search ..... 165/152, 153, 170, 175; 29/157.3 R

[56] References Cited

U.S. PATENT DOCUMENTS

| | | | |
|---|---|---|---|
| 4,470,455 | 9/1984 | Sacca | 165/153 X |
| 4,615,385 | 10/1986 | Sapestein | 165/175 |
| 4,696,342 | 9/1987 | Yamauchi | 165/152 |
| 4,805,693 | 2/1989 | Flessate | 165/153 |

*Primary Examiner*—Robert G. Nilson

*Attorney, Agent, or Firm*—Bean, Kauffman & Spencer

[57] ABSTRACT

An improved automotive condenser and method for its production is disclosed, having particular application in cooling utilities wherein resistance to high internal fluid pressures is required. The condenser comprises elongated hollow energy exchange structures extending between header tanks, the hollow structures being formed from opposing elongated plates, undulating in cross-section to form a plurality of longitudinally extending opposing crests and valleys, wherein the opposing valleys are crossed, at a maximum distance between points of crossing valleys of no greater than about 0.2 inches, and said crossing valleys are joined at substantially all crossing points defining longitudinally extending hollow passages between the connected valleys.

20 Claims, 1 Drawing Sheet

Fig. 1.
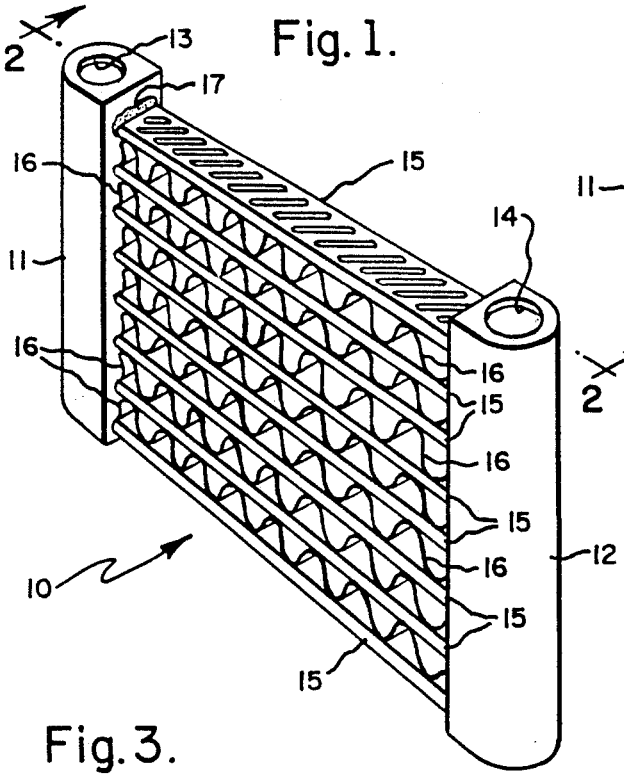
Fig. 2.
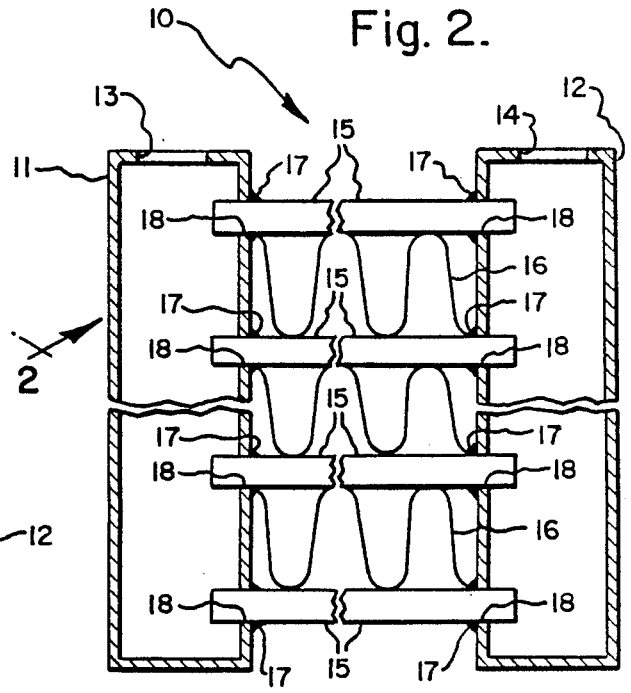
Fig. 3.
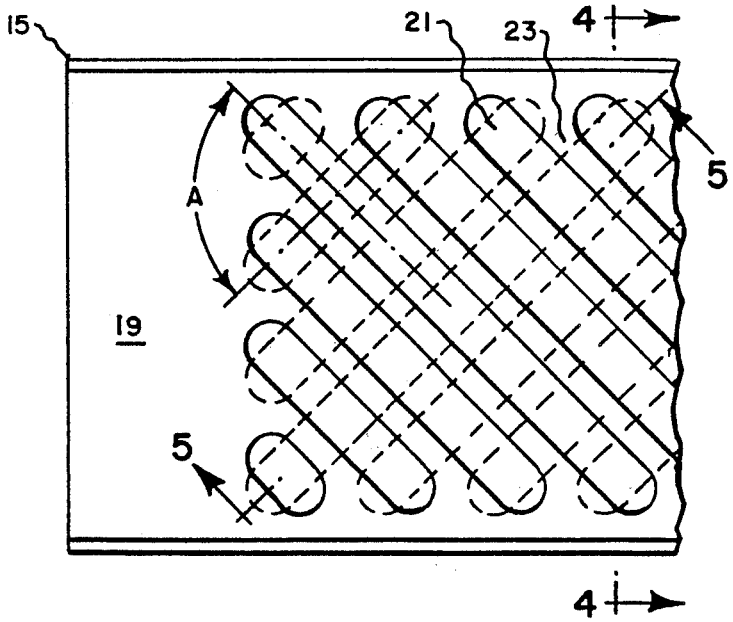
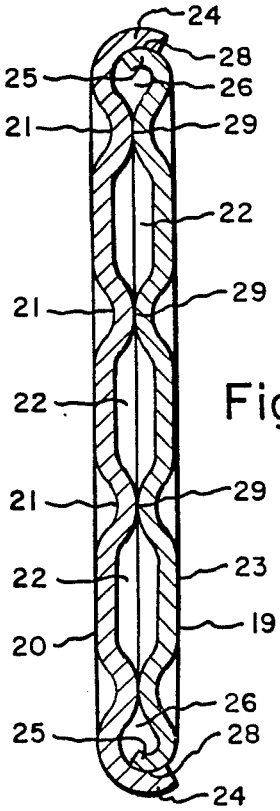
Fig. 4.
Fig. 5.
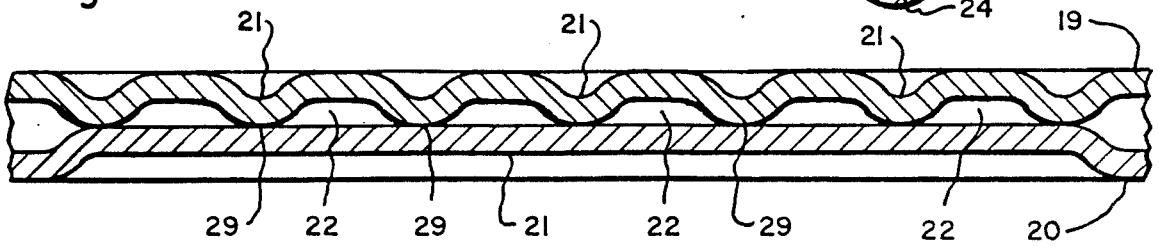

AUTOMOTIVE CONDENSER

This invention relates to an improved automotive condenser, having particular application in utilities where resistance to high internal fluid pressures is required.

BACKGROUND OF THE INVENTION

The widespread use of heat exchangers in the automotive industry, coupled with the continuing need to provide lighter and more efficient devices, has occasioned the development of a multiplicity of new designs and configurations in the manufacture of condensers for use in automotive refrigeration systems.

Early heat exchangers, still in widespread use as condensers in automotive refrigeration systems, typically comprise a continuous serpentine configured tube through which gaseous and/or liquid fluids can flow. Plates or fins, introduced in contact with the serpentine tube, provide increased energy exchange surface areas. A cooling medium, such as ambient air, is passed over the tube and plates or fins thus allowing energy exchange from the warmer fluid in the tube to the cooling medium. To allow convenient assembly, the continuous tubes are manufactured from multiple "U" shaped elements to allow insertion through the fins and after assembly the elements are joined together by "U" tube connectors to form the continuous serpentine tube. In recent years, improved systems comprise parallel, spaced header tank structures interconnected with multiple parallel energy exchange tubes to allow flow of fluid, e.g. gaseous and/or liquid, between the header tanks. The multiple tubes are typically rounded or rectangular in configuration and have plate or convoluted fins disposed across or between the tubes to increase the heat exchange efficiency of the energy exchange tubes. The device is typically formed by inserting the multiple tubes into holes in the header tanks, placing convoluted fins between the tubes, welding or brazing the tubes to the header tanks and the fins to the tubes.

In the operation of a typical condenser, refrigerant gas flows through the energy exchange tubes and is cooled or condensed substantially to a liquid by a cooling air stream flowing over the tubes. The direction of the refrigerant flow stream and the cooling air flow stream are generally perpendicular to one another. The dimension along the length of one edge of the tube perpendicular to the air stream is the leading edge contacting the flow air stream and the width of this leading edge is generally referred to as the transverse dimension of the energy exchange tube. The transverse dimension of a tube is thus the average width of the tube. Therefore, a rounded tube has a traverse dimension equal to its diameter and a rectangular tube one equal to the width of its leading edge surface.

There has been a recognition that the rounded type energy exchange tube may lack the efficiencies needed for many modern automotive applications. In particular, the width of the leading edge acts as an obstruction to the air stream and it is generally desirable to minimize this obstruction. Though the rounded configuration is particularly suitable to resist the high internal fluid pressures of the automotive condenser systems, significant manufacturing assembly problems have been encountered in forming automotive condensers from small, less than 0.20 inches, rounded exchange tubes. Thus the smallest round tubes typically commercially used are larger than about 0.20 inches in diameter creating a manufacturing barrier to the formation of traverse dimensions less than about 0.2 inches.

To further reduce the width of the leading edge, e.g. reduce the transverse dimension, substantially rectangular energy exchange tubes have been proposed and are finding a degree of acceptance in the industry along with various modified rectangular configurations. Such configurations allow a smaller traverse dimension than round tubes, however, it is desirable to still further minimize air flow obstruction for the overall efficiency of the condenser.

U.S. Pat. No. 4,615,385, though particularly concerned with header tank construction, discloses a typical modified rectangular configured energy exchange tube with a plurality of tubes connected in parallel between header tanks. Therein, the tube is disclosed as being flattened such that the smallest dimension of the rectangle comprises a rounded surface which is arranged in the device to comprise the traverse dimension.

U.S. Pat. No. 4,688,311 discloses a process to manufacture a modified rectangular configured energy exchange tube which can be effective in resisting the high internal fluid pressures of automotive refrigeration systems. Therein a rectangular tube comprising the rounded configuration at the traverse dimension of U.S. No. 4,615,385, is internally fitted with an undulating fin insert which is joined with the interior of the tube throughout its longitudinal length. The internal fins act as tension struts to help withstand internal fluid pressures. Such tube requires the use of added materials in construction and is difficult to fabricate because of the difficulties of fin insertion into the tube.

It is an object of this invention to provide energy exchange structures having efficient air flow resistance at their transverse dimension.

It is a further object of the invention to provide energy exchange structures having resistance to internal fluid pressures.

It is another object of the invention to provide an automotive condenser having resistance to internal fluid pressures.

It is still another object of the invention to provide a method of manufacturing an energy exchange structure having efficient air flow resistance and resistance to internal fluid pressures.

These and other objects of the invention are achieved by the invention described as follows:

SUMMARY OF THE INVENTION

The invention comprises an improved automotive condenser, comprising elongated, generally rectangular, hollow energy exchange structures extending between header tanks. The hollow structures are comprised of opposing elongated plates, joined along elongated longitudinal edges to define a passage extending in the longitudinal direction of the plates, said opposing plates undulating in cross-structure to define generally parallel crests and valleys obliquely disposed to the longitudinal direction. Valleys of a first plate are arranged to cross valleys of a second plate such that the maximum distance between crossing points of crossing valleys is no greater than about 0.2 inches. Crossing valleys are joined and opposing crests define crossing, obliquely disposed, passages longitudinally extending through the energy exchange structure.

The improved automotive condensers of the invention are produced by a process wherein elongated plates, undulating in cross-section to have a plurality of oblique angularly disposed and longitudinally extending crests separated by valleys, are arranged such that apexes of valleys of a first plate cross apexes of valleys of a second plate at a maximum distance between crossing points no greater than about 0.2 inches. The valleys of said first and second plates are then joined at crossing points and the crests define angularly arranged, crossing, longitudinally extending hollow passages in a tubular energy exchange structure. Multiple tubular energy exchange structures are typically assembled in parallel to form the condenser, with a first end of the energy exchange structures extending to a first header tank, and a second end of said energy exchange structures extending to a second header tank to form the automotive condenser.

DESCRIPTION OF THE DRAWINGS

FIG. 1 is a perspective view of an automotive condenser made in accordance with the present invention.

FIG. 2 is a fragmentary enlarged sectional view taken approximately on line 2—2 of FIG. 1.

FIG. 3 is a plan view of an energy exchange structure made in accordance with the present invention.

FIG. 4 is an exploded enlarged sectional view taken along line 4—4 of FIG. 3.

FIG. 5 is a view similar to FIG. 4, but showing the parts in assembled condition. This view is taken approximately on line 5—5 on FIG. 3.

DETAILED DESCRIPTION OF THE INVENTION

An exemplary embodiment of an automotive condenser made according to the invention is illustrated in FIG. 1. It should however be understood that the present invention can be utilized in a plurality of other condensers wherein an energy exchange structure is extending between headers.

Referring now to FIG. 1, therein a typical automotive condenser 10 is illustrated, comprising inlet header tank 11 and generally parallel opposing outlet header tank 12. Inlet header tank 11 comprises inlet 13 and outer header tank 12 comprises outlet 14. A plurality of hollow energy exchange structures 15 extend between the opposing header tanks and disposed therebetween are convoluted fins 16 in energy exchange relationship with the hollow energy exchange structures. In the embodiment of FIG. 1, the plurality of energy exchange structures 15 are joined to inlet header tank 11 and outlet header tank 12 by brazing welds 17 as further illustrated in FIG. 2. Convoluted fins 16 are inserted between the plurality of energy exchange structures and are in intimate contact therewith.

In a typical operation of the illustrated embodiment, a first, heat energized, gaseous fluid such as a refrigerant enters inlet header tank 11 through inlet 13, flows through the longitudinally extending passages of the plurality of hollow energy exchange structures and into outlet header tank 12. The flow of gaseous fluid through the exchange structures is directed by the angularly disposed crests and valleys of the opposing elongated plates in a disjointed, convoluted path wherein the fluid stream is passively separately and mixed by the crossing paths of joined valleys increasing fluid stream contact with the elongated plates. Heat energy from the fluid is dissipated to the opposing plates of the energy exchange structures and to the convoluted fins in contact therewith. A second fluid flow, such as ambient air, is imposed upon the condenser such that the second fluid flows across the cross-section of the energy exchange structures and across the convoluted fins. Heat energy dissipates from such structures and fins to the second fluid flowing across when the heat energy of the second fluid is less than that of the energy exchange structures and/or the convoluted fins. With the dissipation of sufficient heat from the gaseous first fluid to the second fluid, the first gaseous fluid condenses to a liquid which flows through the remaining length of the energy exchange structures to outlet header tank 12 and through outlet 14 for treatment in other parts of the system.

Referring now to FIG. 2, therein is illustrated a sectional view of the condenser of FIG. 1 wherein inlet and outlet header tanks 11 and 12 are provided with a plurality of generally parallel, spaced apart, elongated holes 18, configured to receive the open ends of the plurality of elongated, hollow, energy exchange structures 15 and allow a flow of gaseous and/or liquid material therebetween. The exchange structures are sealed to the headers by any appropriate bonding means that provides sufficient structural integrity to withstand the pressures generated within the system that the condenser will be used. Braze weld 17 is illustrated as a preferred embodiment when the materials of construction are aluminum.

The energy dissipating fins may be bonded to the energy exchange structures, preferably with a heat energy conducting material, or may be fitted to the structures depending upon the service expected within the system. As an alternate to the convoluted fins previously described, flat plates can generally be provided with elongated holes therein generally conforming to the cross-section of the energy exchange structures and can be inserted thereover. Typically it is preferred that the energy dissipating convoluted fins or flat plates comprise at least about the same width as the energy exchange structures and that they contact the exchange structures throughout as much of the energy exchange structure width as possible. Energy dissipating plates are typically thin and manufactured from highly conductive material. Fins 16, of condenser 10, comprise a thin, conductive material of about the same width of energy exchange structures 15 and are tightly fitted between the plurality of exchange structures to maintain their structural integrity in the condenser.

FIGS. 3, 4 and 5 illustrate a preferred embodiment of the energy exchange structures 15 of the invention wherein crests form generally rectangular passages in the central section of the body of the structure and passages having a generally circular surface are formed at the joined longitudinal edges thereof. Therein, energy exchange structure 15 comprises undulating elongated top plate 19 and undulating elongateed bottom plate 20 joined at crossing valleys 21, to form generally rectangular passages 22. The undulations in plate 19 are oblique to the undulations of plate 20. Joining the opposing plates at overlapping outer longitudinal edge 24 and underlapping inner longitudinal edge 25 forms passages 26 having a generally circular surface. Alternately, edge 24 and 25 may be brought together and joined in a common plane parallel to the major plane of the plates and may even comprise an extended, flat surface. In the preferred embodiment illustrated, the longitudinal edges are brazed at interface 28 and crossing valleys 21 are brazed at crossing points 29 to insure structural integrity of the hollow passages of the energy exchange structures.

The valleys and crests of the elongated plates can be conveniently formed by stamping, embossing or otherwise forming the desired shaped valleys in the elongated plates. When a series of generally parallel adjacent valleys are so formed, the area between the valleys comprises adjacent crests. It should be understood that other means well known in the art are contemplated for use in the formation of the valleys and crests and it is contemplated that crests also be stamped or otherwise formed in the plate to protrude above the plane of the plate.

Generally the crests and valleys will be at an oblique angle to the longitudinal direction of the elongated plate. Preferably, the oblique angle will be from about 10 to about 85 degrees from the longitudinal direction of the plate and most preferably from about 20 to about 70 degrees.

Opposing first and second elongated plates, having angularly disposed valleys, are assembled so that the valleys of the first plate cross opposing valleys of the second plate. It is not essential for the valleys or crests of the first plate to be at the same oblique angle to the longitudinal direction as those of the second plate, though such is generally preferred.

Included angles of crossing of the valleys, that is an angle formed by the crossing valleys and opening to the longitudinal direction of the assembled plates, generally can be from about 20 to about 170 degrees. FIG. 3 illustrates joined elongated plates wherein crossing valleys form an included angle A of about 90 degrees. An included angle will approach 0 degrees as the oblique angle of the valleys of opposing elongated plates approaches the longitudinal direction and will approach 180 degrees as the oblique angles approach a perpendicular to the longitudinal direction.

The valleys in the opposing plates are preferably formed with a small interior vertex radius at their apex. The interior vertex radius is preferably not greater than about 1.5 times the thickness of the material from which the plate is manufactured and most preferably less than about the thickness of the material.

The crest width comprises the dimension of the plate between vertices of adjacent valleys and such dimensions is variable depending upon the internal pressure contemplated within the exchange structure and the extent of joining of the crossing valleys of opposing plates. Thus, to provide greater resistence to rupture, the width of crests on a plate with a defined number of joined crossing valleys in a high internal pressure system would typically be smaller than that in a low internal pressure system. Generally the width of crests is preferably greater than about 2.5 times the thickness of the material from which the plate is made and less than about 7 times the thickness.

In the automotive condenser application of the invention, it is preferred that the material thickness of the opposing plates be from about 0.012 to about 0.030 inches and most preferred from about 0.012 to about 0.028 inches. The internal radius of the valleys is preferably about 1.5 times the plate material thickness or less and the width of the crests are preferably from about 2.5 to about 7 times the plate material thickness. Heat exchange structures having the configuration of the invention and dimensioned within the preferred ranges can thus preferably be made having a traverse dimension of about 0.125 inches or less.

Typically, the condensers of the invention can be manufactured from any convenient material that will withstand the corroding effects and internal fluid pressures of the system. Typical materials include the malleable metals, such as aluminum and copper, particularly alloys thereof. The materials may be internally or externally coated, treated or the like. Typically, it is desirable to use as thin a material as possible in the exchange structures to gain maximum efficiency in the energy exchange process.

Generally, each of the components of a condenser are desirably formed from the same materials when they are to be joined together. For example, the plates used to manufacture the energy exchange structures would be typically formed from the same material. The header tanks and the energy exchange structures would also be formed from the same metal or metal alloy as they are typically brazed or welded together.

It should be understood that though the illustrated invention comprises an automotive condenser, the invention is seen as being applicable to multiple heat exchange utilities.

I claim:

1. An improved automotive condenser, comprising elongated, generally rectangular, hollow energy exchange structures extending between header tanks, said hollow structures comprising first and second opposing elongated plates joined along elongated longitudinal edges to define a tube having a generally rectangular cross-section with generally rounded edges and a passage extending in a longitudinal direction, said opposing plates undulating in cross-section to define generally parallel crests and valleys obliquely angled to the longitudinal direction and set away from the rounded longitudinal edges of the tube, valleys of the first opposing plate being angularly disposed to cross opposing valleys of said second plate, at a maximum distance between points of crossing valleys of no greater than about 0.2 inches and said crossing valleys being joined at substantially all crossing points, said longitudinal edges of said elongated plates forming longitudinally extending passages at the edges comprising a generally rounded exterior edge surface.

2. The condenser of claim 1 wherein the included angle formed by the crossing of valleys of opposing plates is from about 20 to about 170 degrees.

3. The condenser of claim 1 wherein the joined longitudinally extending edges of the elongated plates comprise a transverse dimension of less than about 0.125 inches.

4. The condenser of claim 1 wherein said elongated plates have an average material thickness from about 0.012 to about 0.030 inches.

5. The condenser of claim 1 wherein crests between opposing valleys have a generally rectangular cross-section.

6. The condenser of claim 1 wherein said generally rounded surface comprises joined overlapping edges of said elongated plates.

7. The condenser of claim 1 wherein said valleys are joined by brazing or welding means.

8. The condenser of claim 1 comprising energy dissipating plates extending from said elongated hollow structures.

9. The condenser of claim 8 wherein said energy dissipating plates comprise plate fins.

10. The condenser of claim 8 wherein said energy dissipating plates comprise a convoluted plate contacting said hollow structure at points along its longitudinal length.

11. The condenser of claim 1 wherein the internal radius of valleys is less than about 1.5 times the plate thickness.

12. The condenser of claim 1 wherein the width of crests is from about 2.5 to about 7 times the plate thickness.

13. A process for forming an improved automotive condenser of claim 1 comprising forming elongated plates, undulating in cross-section and having a plurality of generally parallel crests separated by valleys and oblique angularly disposed to the longitudinal edges of the plates; arranging said plates such that apexes of valleys of a first plate are arranged to cross apexes of valleys of a second plate at a maximum distance between points of crossing valleys of no greater than about 0.2 inches; joining apexes of valleys of said first and second plates and longitudinal edges of said plates to form a tubular energy exchange structure; assembling a first end of said energy exchange structure to a first header tank; and extending a second end of said energy exchange structure to a second header tank to form an automotive condenser.

14. The process of claim 13 wherein the included angle formed by the crossing of valleys of opposing plates is from about 20 to about 170 degrees.

15. The process of claim 13 wherein the joined longitudinally extending edges of the elongated plates comprise a traverse dimension of less than about 0.125 inches.

16. The process of claim 13 wherein said elongated plates have an average material thickness from about 0.012 to about 0.030 inches.

17. The process of claim 13 wherein the internal radius of valleys is less than about 1.5 times the plate thickness and the width of crests is from about 2.5 to about 7 times the plate thickness.

18. An improved automotive condenser, comprising elongated, generally rectangular, hollow energy exchange structures extending between header tanks, said hollow structures comprising first and second opposing elongated plates, having an average thickness of from about 0.012 to about 0.030 inches, joined along elongated longitudinal edges to define a tube having a generally rectangular cross-section with generally rounded edges and a passage extending in a longitudinal direction, said opposing elongated plates undulating in cross-section to define generally parallel crests and valleys obliquely angularly disposed to the longitudinal direction and set away from the rounded longitudinal edges of the tube, with valleys of the first opposing plate being angularly disposed to cross valleys of the second opposing plate, at a maximum distance between points of crossing valleys of no greater than about 0.2 inches and being joined at substantially all crossings, said longitudinal edges of said elongated plates forming longitudinally extending passages at the edges comprising a generally rounded exterior edge surface.

19. The condenser of claim 18 wherein the included angle formed by the crossing of valleys of opposing plates is from about 20 to about 170 degrees.

20. A hollow energy exchange structure comprising first and second opposing elongated plates, joined along elongated longitudinal edges to define a tube having a generally rectangular cross-section with generally rounded edges and a passage extending in a longitudinal direction, said opposing plates undulating in cross-section to define generally parallel crests and valleys obliquely angularly disposed to the longitudinal direction and set away from the longitudinal rounded edges of the tube, with valleys of the first opposing plate being angularly disposed to cross valleys of said second plate, at a maximum distance between points of crossing valleys of no greater than about 0.2 inches and said crossing valleys being joined at substantially all crossing points, said longitudinal edges of said elongated plates forming longitudinally extending passages at the edges comprising a generally rounded exterior edge surface.

* * * * *